United States Patent [19]

Hanscom

[11] 4,118,010

[45] Oct. 3, 1978

[54] MULTI-PURPOSE LIFTING AND MOUNTING ASSEMBLY

[76] Inventor: Russell C. Hanscom, 3027 Diss/ P.O. Box 1822, Santa Maria, Calif. 93454

[21] Appl. No.: 868,175

[22] Filed: Jan. 9, 1978

[51] Int. Cl.[2] ..... B66F 5/02

[52] U.S. Cl. ..... 254/124; 254/134

[58] Field of Search ..... 254/8 R, 8 B, 124, 133, 254/134; 269/77, 17, 47

[56] References Cited

U.S. PATENT DOCUMENTS

| | | | |
|---|---|---|---|
| 2,675,209 | 4/1954 | Freed | 254/124 |
| 3,059,785 | 10/1962 | Buckeye | 254/8 R |
| 3,062,500 | 11/1962 | Arnes et al. | 254/134 |
| 3,765,667 | 10/1973 | Christiansen | 269/77 |

*Primary Examiner*—Robert C. Watson

*Attorney, Agent, or Firm*—Kenneth J. Hovet

[57] ABSTRACT

A convertible boom is supported by an upstanding post and base frame. The boom is provided with appropriately located connectors so that it may be attached to the upper portion of the post to form a hoist or it may be connected proximate the bottom of the post to create a jacking device. In both cases, a portable jack is used to actuate the boom. The end of the boom may be equipped with a rotatable and tiltable cradle having extendable arms. The upstanding post may be provided with a rotatable workpiece mount which includes a plate having a plurality of outwardly projecting pins which extend through slotted connector rods. The rods can be arranged in a variety of positions to facilitate connection to a workpiece.

8 Claims, 16 Drawing Figures

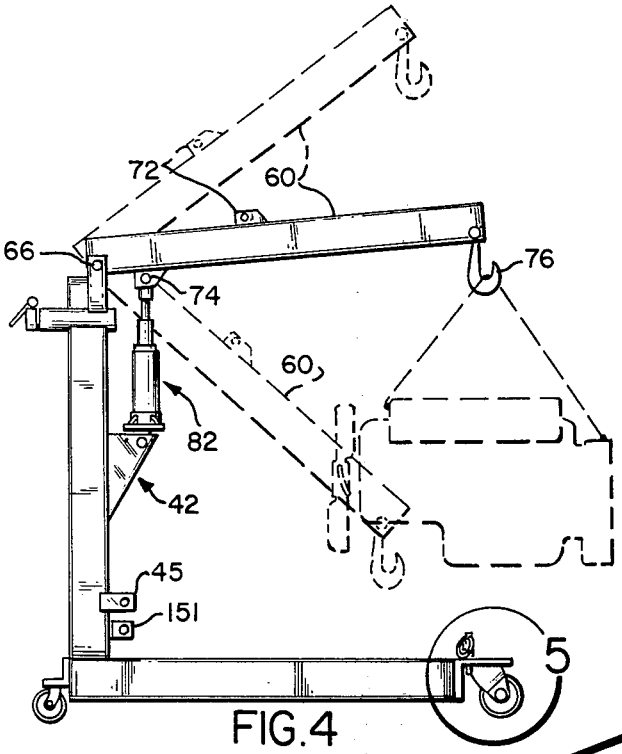
FIG.4
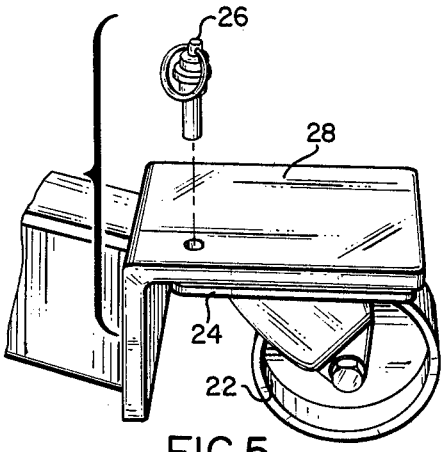
FIG.5
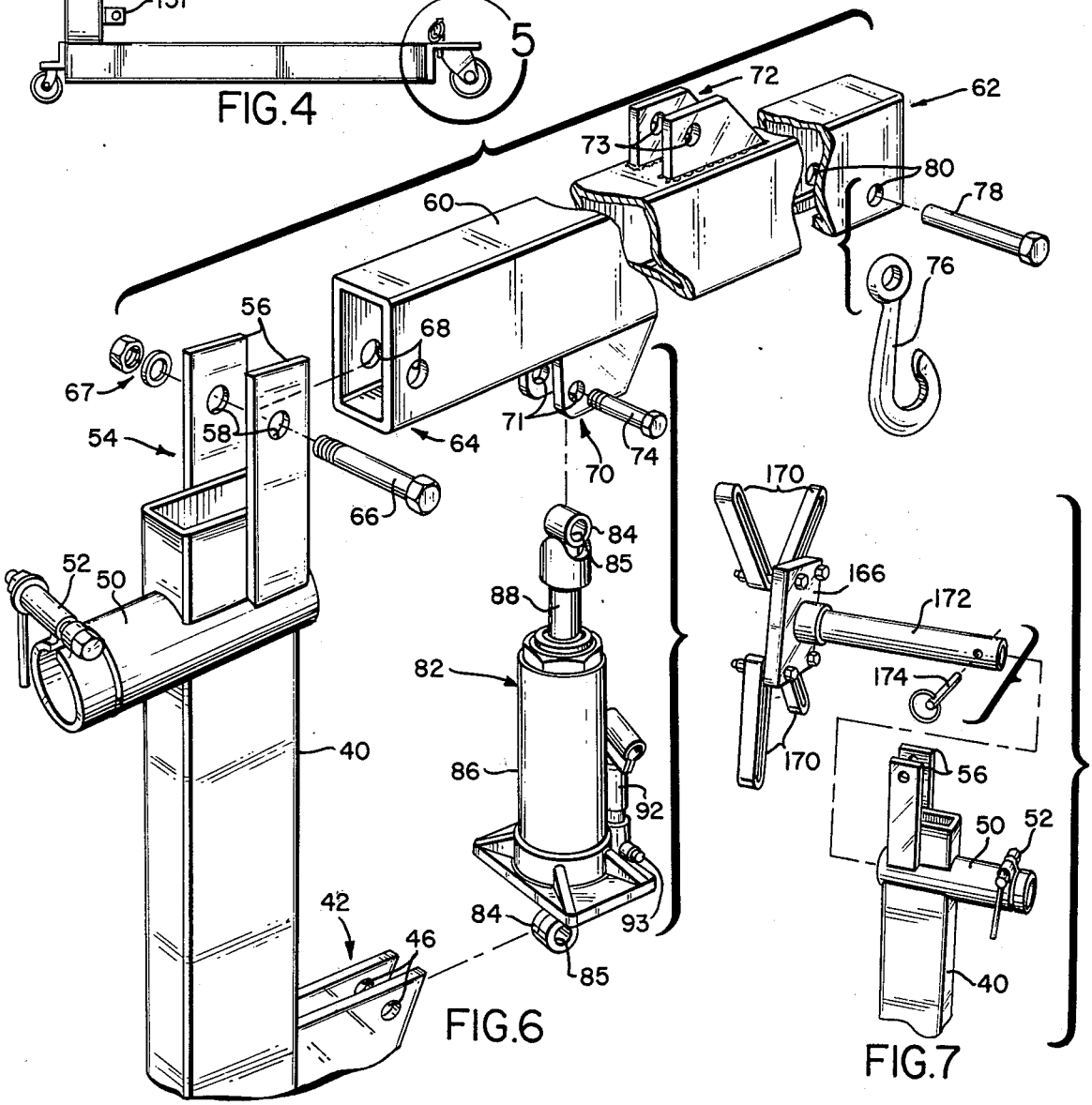
FIG.6
FIG.7

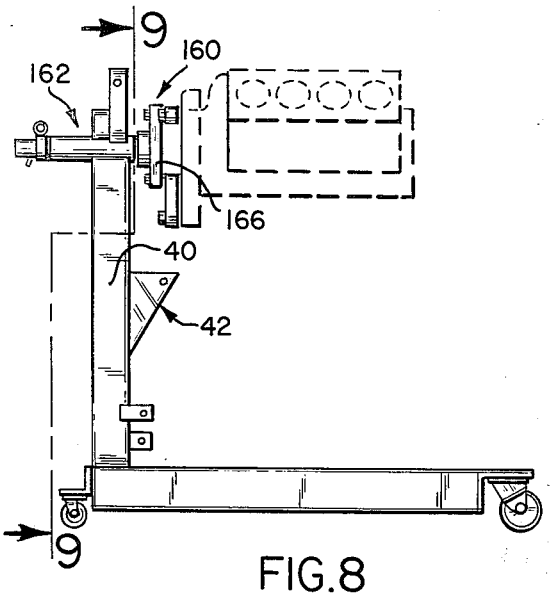
FIG.8
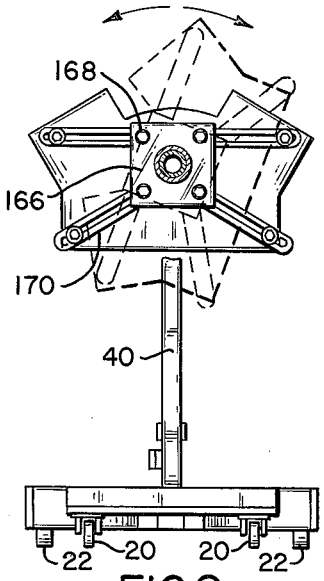
FIG.9
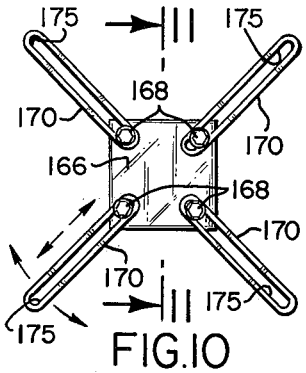
FIG.10
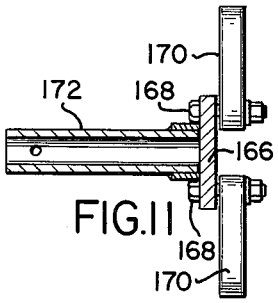
FIG.11
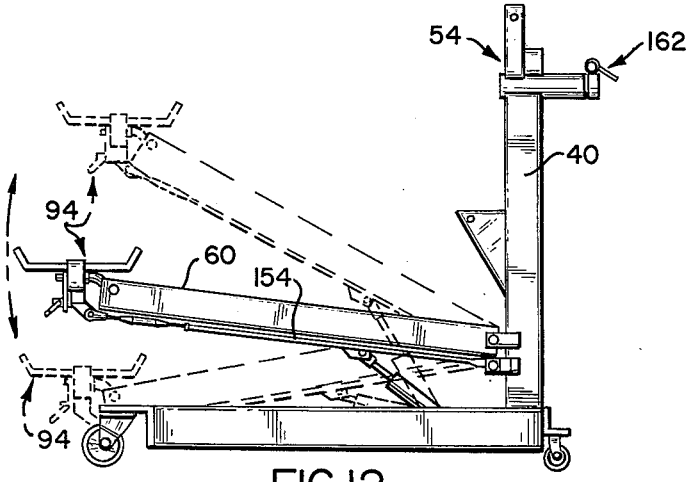
FIG.12
FIG.15
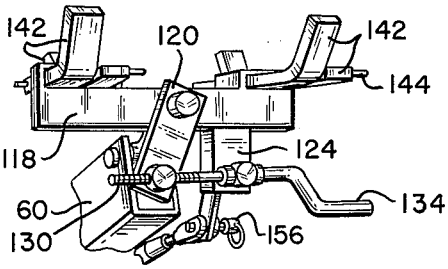
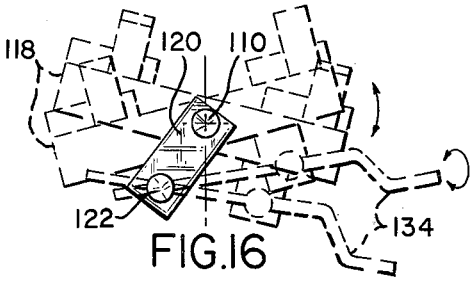
FIG.16
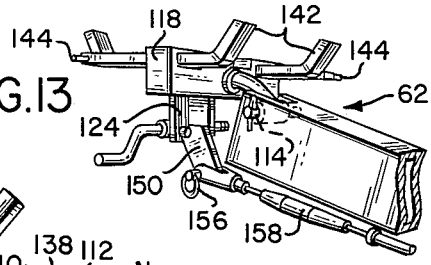
FIG.13
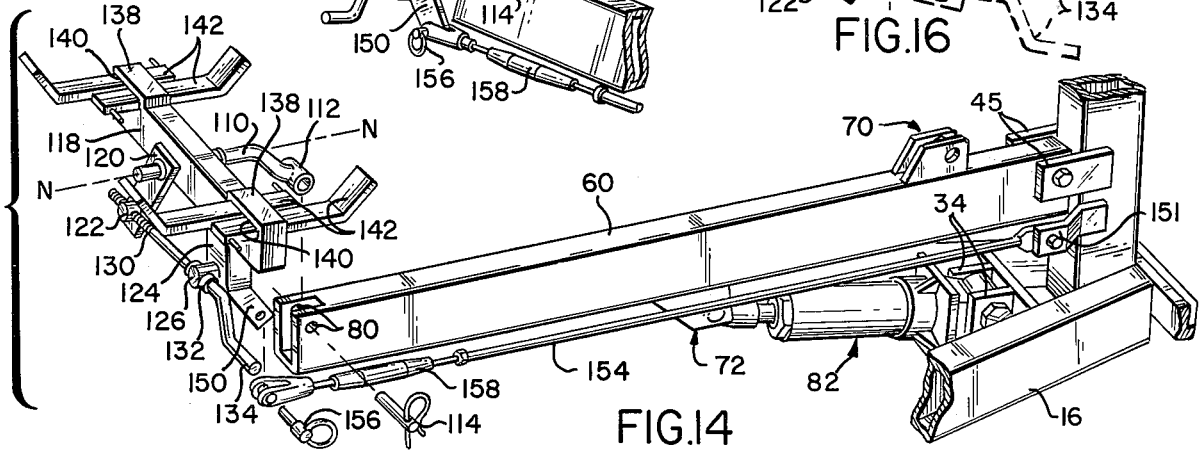
FIG.14

MULTI-PURPOSE LIFTING AND MOUNTING ASSEMBLY

BACKGROUND OF THE INVENTION

1. Field of the Invention

The present invention relates to lifting and mounting devices and, more particularly, to a multi-purpose assembly adapted to function as a hoist, jack and/or workpiece mount.

2. Description of the Prior Art

Heretofore, relevant art described a jacking device in combination with a hoisting mechanism. This combination was desirable because it allowed for a repair shop or service station to have one assembly that would lift engines out of cars and remove transmissions from beneath the car. These devices were not generally susceptible to being broken down for storage and were large, cumbersome and unwieldly in operation.

U.S. Pat. No. 3,059,785 discloses a device which provides for a telescoping hoist actuated by a hydraulic or air-powered cylinder with a transmission lifting assembly operated by a jack-screw mechanism. The device also provides a plate having orifices therethrough for securing transmissions and the like.

It is readily apparent that the device of the character just described would be extremely expensive to construct and large and unwieldy to operate. None of the actuating or support components are convertible and one may not be substituted for another thereby allowing for a more compact, less expensive unit.

SUMMARY OF THE INVENTION

The present invention provides an assembly of component parts which can be combined in various ways to produce a multi-functioning apparatus without creating an unwieldy structure or one that is too expensive for typical automotive repair shops to purchase. The novel multi-purpose assembly utilizes an elongated upright member extending from a base frame in combination with a movable jack unit and a convertible lifting beam. By the appropriate location of connector assemblies on the lifting beam, the assembly may function as a hoist or a jacking device.

The base frame is provided with a first support means for mounting the jack unit. The jack unit connects with a lifting beam pivotally connected near the lower end of the upright member to effect the raising and lowering of the beam. In this way the assembly functions as a jacking device.

The upright member is provided with a second support means upon which is mounted the jack unit when the assembly is functioning as a hoist. The jack unit is connected to the beam and the beam is pivotally attached to the upper portion of the upright member.

When the assembly is arranged to operate as a jacking device, an adjustable cradle assembly may be utilized to support and remove transmissions and the like from beneath an automobile. In such a case, the present invention contemplates that the end of the lifting beam include a removably mounted cradle means comprising a pivot rod extending through a transversely positioned carriage member. The carriage member is supported by the pivot rod and mounted thereon so that it may rotate about its normal axis a predetermined amount.

The pivot rod has a terminal end with a first bracket affixed thereto. A second bracket means is affixed to the carriage member such that a linkage means may be utilized to interconnect the brackets. The linkage means functions to vary the distance between the brackets which thereby regulates the angularity of the carriage member about its aforementioned normal axis.

The carriage member includes transversely extending cross bars which may be extended or retracted through slots in the carriage member. The cradle means includes the use of a pivotally connected tie rod which extends between the cradle and the lower portion of the upstanding upright member. Since the cradle is pivotally mounted upon the end of the lifting beam, the tie rod operates to maintain the cradle at a fixed angle independent of the lifting beam movement.

The present invention is also adapted to function as a stand upon which various workpieces may be mounted for easy access. The upright member includes an attachment means comprising a housing and locking means for securing a workpiece mounting means. The mounting means comprises a plate having a plurality of outwardly projecting stationary pins. Each of the pins is provided with a slotted connector rod whereby the rod is inserted over the pin and is movable along the confines of the slot so that its relative position may be changed to facilitate connection to a workpiece.

BRIEF DESCRIPTION OF THE DRAWINGS

FIG. 4 is a side elevation view of the invention shown in FIG. 1 illustrating its use as a hoist lifting an engine;

FIG. 5 is an enlarged fragmentary view taken along the circular line 5 of FIG. 4 with a swivel stop pin exploded therefrom;

FIG. 6 is an enlarged fragmentary exploded view showing a portion of the upstanding member, lifting beam and jack unit when functioning as a hoist;

FIG. 7 is an exploded fragmentary view of the upper portion of the invention illustrated in FIG. 2;

FIG. 8 is a side elevation view of the invention illustrated in FIG. 2 showing the workpiece mounting means with an engine attached thereto;

FIG. 9 is a view taken along lines 9—9 of FIG. 8 illustrating rotation in phantom of workpiece mounting means with engine attached.

FIG. 10 is a front detailed view of the workpiece mount shown in FIG. 9;

FIG. 11 is a cross-sectional view taken along lines 11—11 of FIG. 10;

FIG. 12 is a side elevation view of the assembly shown in FIG. 3 showing the movement of the lifting beam with the cradle means attached;

FIG. 13 is an enlarged fragmentary perspective view of the cradle means of FIG. 12 attached to the end of the lifting beam;

FIG. 14 is a fragmentary perspective view of the lifting beam jack unit and an exploded illustration of the cradle means shown in FIG. 12;

FIG. 15 is a fragmentary front perspective view of the cradle means shown in FIG. 12; and, FIG. 16 shows rotation in phantom of the cradle means shown in FIG. 12 about its normal axis.

DESCRIPTION OF THE PREFERRED EMBODIMENTS

Figure 1:
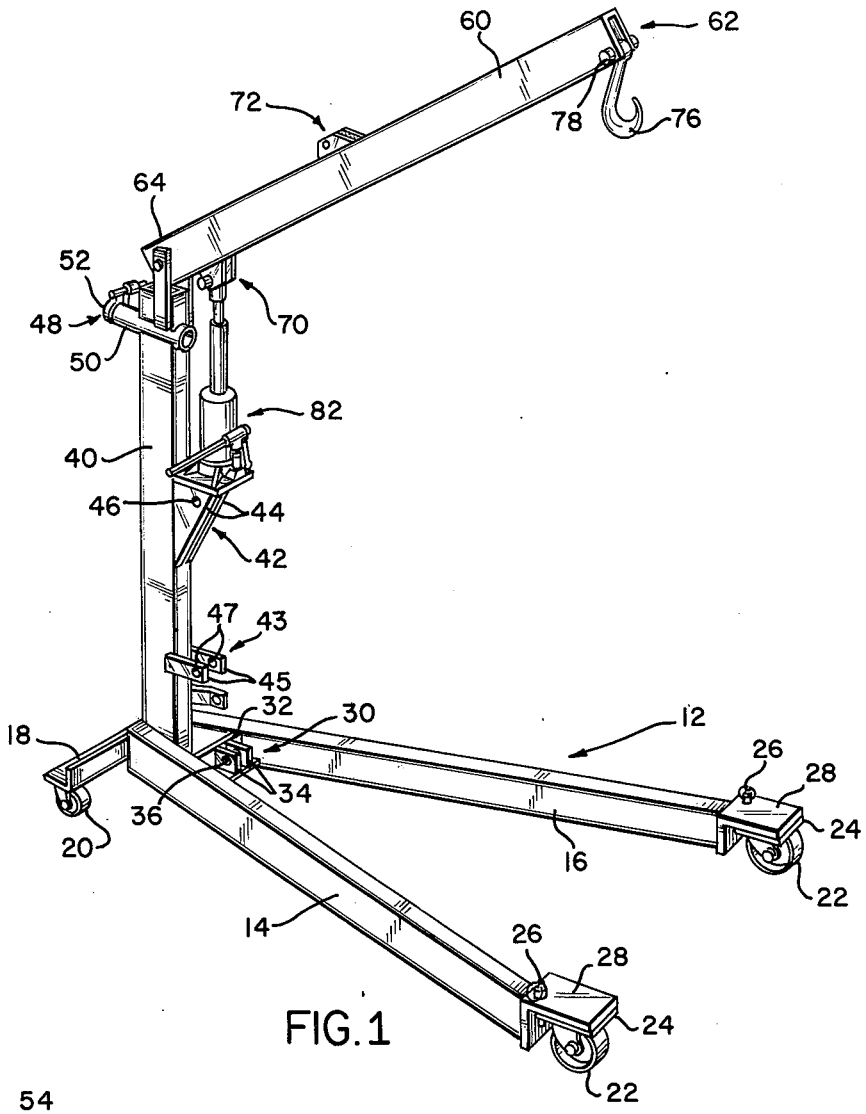
FIG. 1 is a perspective view illustrating the invention as a hoist.
Figure 2:
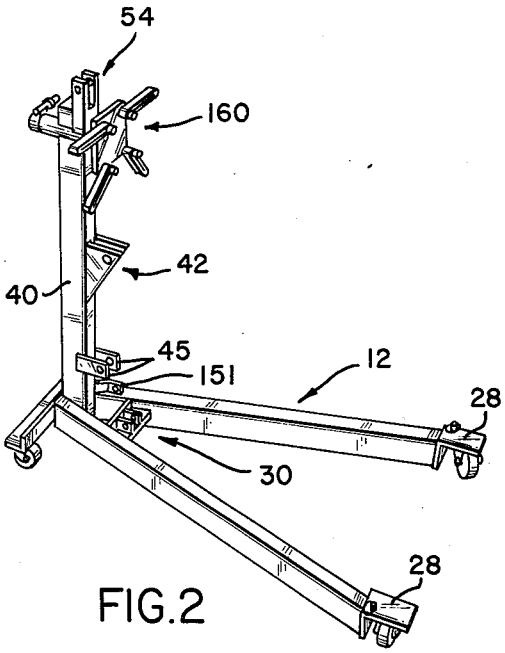
FIG. 2 is a perspective view of the invention showing the workpiece mounting means secured to the upright member.

Referring now with greater particularity to the various figures of the drawings, it will be seen that numeral 12 indicates generally the base frame component of the invention. The base frame is V-shaped and consists of legs 14 and 16 shown as diverging hollow beams. The legs converge toward a cross beam shown as angle iron 18. The converging ends of each leg are welded or otherwise affixed to the middle portion of the angle iron which extends an equal distance beyond either side of the legs and is provided with casters 20 at opposing ends. Similarly, the diverging end of each leg is provided with casters 22 which are secured to pivot plates 24. As shown in FIG. 5, removal of stop pin 26 will permit the pivot plate to slide beneath top plate 28 and allow casters 22 to swivel therewith. In this matter, the overall assembly may be moved about in any direction.

Located toward the converging juncture of the legs is first support means 30. The first support means comprises a bridge plate 32 from which extend spaced apart parallel brackets 34. The brackets are provided with aligned matching openings 36.

Extending upwardly from the converging ends of legs 14, 16 is upright member 40. The upright member may be affixed to cross beam 18 and legs 14, 16 by welding or may be optionally removably secured thereto by socket means, bolts, pins, or the like (not shown). The upright member is a rectangular in cross-section hollow member having a bottom portion secured to the base frame 12, as aforementioned, and includes a second support means 42 located above said bottom portion. The second support means comprises spaced apart brackets 44 which extend inwardly and are parallel to each other. Each of the brackets is provided with a matching aligned opening 46.

The upright member 40 includes attachment means 48 (for a purpose to be hereinafter described) located near the upper portion thereof. The attachment means comprises an annular housing 50 and locking means 52 which may be any means well known in the art such as a set screw, tapered bushing or the split ring clamp shown best in FIG. 6.

Near the top portion of upright member 40 is upper pivot connection means 54 comprising spaced apart brackets 56 secured to opposite sides of member 40 and having aligned matching openings 58. When the assembly of the present invention is to be arranged to function as a hoist, a lifting beam 60 will be pivotally attached to the aforementioned upper connection means 54. In this regard, note the lifting beam has an attachment end portion 62 and a pivot end portion 64. As best shown in FIG. 6, the pivot end portion is mounted for rotation by placing the beam pivot end portion 62 between brackets 56 and aligning openings 58 with corresponding beam openings 68. A pin 66 is inserted therethrough and secured in place with a bolt, nut, and washer 67 as shown, or with cotter pins, retainer rings or other means well know in the art.

Lifting beam 60 is an elongated hollow structure which is rectangular in cross-section in a manner similar to upright member 40. The beam is provided with at least two connector assemblies 70 and 72 which are spaced apart along the longitudinal extent of the beam. Each of the connector assemblies comprise spaced apart brackets which extend outwardly from beneath or above the beam in a direction coextensive with the lateral axis thereof and include aligned matching openings through which a bolt or pin 74 may be inserted for connection to a jack unit in a manner to be hereinafter described.

As shown in FIGS. 1, 4 and 8, the attachment end portion 62 of the lifting beam is provided with a hook 76. The hook is suspended therefrom by insertion of pin 78 through orifices 80. Of course, the hook may be replaced with a chain, rope, cable or equivalent load connecting means.

When the apparatus is assembled to function as a hoist shown in FIGS. 1, 4 and 6, a jack unit, shown generally by reference numeral 82, is secured to second support means 42 and connector assembly 70. The jack unit is provided with opposing engagement ends 84 having transverse openings 85 which correspond with aligned openings 36, 46, 71 and 73 such that a pin may be inserted therethrough to effect a pivot connection at either end of the jack unit.

The jack unit may be any conventional portable power transmitting and moving device such as a hydraulic or pneumatic jack, ratchet or screw device. In the preferred embodiment, the jack unit is hydraulically actuated having a cylinder section 86 with a ram 88, handle 90, pump 92 and pressure release valve 93.

Figure 3:
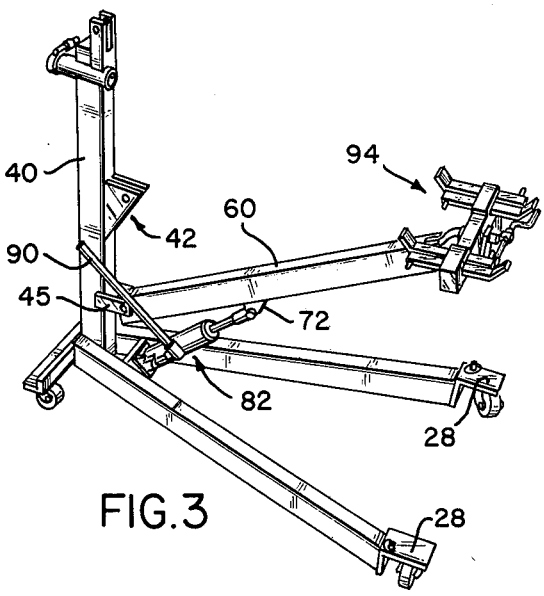
FIG. 3 is a perspective view of the invention illustrating its use as a jacking device with a rotatable cradle attached to the end of the lifting beam.

Referring now to FIG. 3, the apparatus of the present invention is shown assembled to function as a jacking device. In this embodiment the lifting beam pivot end 64 is connected to lower pivot connection means 43. The lower pivot connection comprises brackets 45 extending laterally inwardly from the lower portion of the upright member. Each of the brackets are provided with aligned matching openings 47. The lifting beam openings 68 are aligned with openings 47 and a pivot pin is inserted therethrough. Similarly, top and bottom engagement ends 84 of jack unit 82 will be pivotally connected to connector means 72 and first support means 30 of base frame 12. In this manner actuation of the jack unit will cause the raising of beam 60 in the same way that the beam was moved when connected to the upper portion of the upright member.

Referring now to FIGS. 3 and 12–16, the construction and attachment of cradle means 94 to attachment end 62 of the lifting beam will be described. An elongated pivot rod 110 is provided having a transversely extending engagement end 112 with an orifice therethrough for insertion of a pin means 114. As best shown in FIG. 14, the pin 114 is inserted through openings 80 of the lifting beam and the engagement end orifice to provide the principal connection between the lifting beam and cradle means.

The pivot rod extends through the width of carriage member 118 which is an elongated beam extending about equal distance transversely from both sides of the longitudinal axis of said pivot rod. The pivot rod terminates at a point beyond said carriage member with the end portion thereof immovably attached by welding or the like to a first bracket 120. The bracket is a rectangular shaped piece having a threaded connector 122 journaled thereto proximate the bracket end portion opposite the pivot rod connection. Offset from the first bracket and the normal axis of the carriage member and immovably attached thereto is second bracket 124. The second bracket is also rectangular in shape and depends downwardly from the carriage member in a manner somewhat coextensive with bracket 120. The second bracket includes guide member 126 which is secured to the lower portion thereof. The guide member is provided with an opening through which extends an adjustable linkage means shown specifically as rod member 130. Hydraulic, ratchet, or other motion transmitting means well known in the art may also be utilized.

The rod member threadedly and rotatably engages connector 122 while being secured against axial movement by flanges 132 located on opposite sides of guide member 126. The rod is equipped with an offset handle portion 134 to facilitate its rotation. When the rod member is rotated, the first bracket 120 will remain stationary while the second bracket 124 will be displaced as a result of axial movement of the rod member and the constraint against axial movement relative to the rod member by flanges 132. It will be appreciated that since the first bracket is secured against rotation to pivot rod 110 and the second bracket is immovably attached to the carriage member, displacement of the second bracket will cause rotation of the carriage member about its normal axis shown by lines N-N in FIG. 14. This results in movement of the cradle assembly in the manner shown in phantom in FIG. 16, with the first bracket 120 and pivot rod 110 shown as stationary.

The upper portion of the carriage member is provided with overlying strap elements 138 which are shaped to form two rectangular openings 140 with the top surface of opposing ends of the carriage member. Each of the openings are adapted to allow for the insertion of one pair of slideable cross bars 142. The cross bars are rectangular in cross-section and extend transversely of the longitudinal axis of the carriage member in a direction about parallel to the aforementioned N axis. The cross bars are preferably flat along a major portion of their length with upwardly inclined end portions to facilitate the retention of various types of work pieces. To prevent the cross bars from sliding out of the openings 140, lugs 144 are provided to project transversely as shown from the side of the end of each bar opposite the inclined end portions.

It will be noted that the openings 140 are of a height slightly greater than the thickness of a cross bar and of a width slightly greater than the combined width of each pair of cross bars. In this way, the bars are positioned side-by-side and may slide axially in opposite directions relative to each other with a minimum of wobble or undesirable canting. It will also be understood that the cross bars 142 may be provided with hooks or openings or other fastening means (not shown) at the terminal end of the inclined portions such that a workpiece may be readily chained or strapped thereto.

In addition to having extendable and retractable cross bars and being rotatable about its normal axis, the cradle means includes a tie-rod system which allows one to preset the angle of the N axis relative to the horizontal and maintain such angle regardless of the lifting beam disposition. This is a highly advantageous feature since it facilitates the loading, unloading and movement of heavy and/or irregular shaped workpieces and permits better access to difficult loads.

The system comprises a tie rod 154 pivotally attached at one end to connector 150 by pin 156. The connector depends downwardly from the second bracket 124 a distance sufficient to offset the tie rod from the lifting beam. The opposing end of the tie rod is pivotally connected to bracket 151 which extends inwardly from the lower portion of upstanding member 40. The tie-rod is provided with a longitudinal adjustment means 158 shown in the preferred embodiment as a turn buckle. Rotation of the turn buckle will adjust the length of the tie rod which, in turn, will adjust the horizontal disposition of axis N by causing the rotation of the cradle means about pin 114. It will be appreciated that once the desired level of the cradle is obtained, the level will be maintained as a result of the tie rod maintaining the preset distance between the upright member and connector 150, irrespective of whether the lifting beam is raised or lowered.

Referring now to FIGS. 2 and 7–11, the invention is shown with a workpiece mounting means shown generally by reference numeral 160. The mounting means is connected to the upright member 40 by the hereinbefore described attachment means 48. The mounting means comprises a plate 166 from which extend a plurality of projections 168. The projections 168 are spaced apart in a predetermined pattern and preferably take the form of threaded bolts, pins or the like. The bolts are adapted to extend through slotted connector rods 170. The connector rods are each provided with an enclosed elongated slot 175 such that they may be rotated and/or slid along their longitudinal extent about each of the respective bolts, in the directions shown by the arrows in FIG. 10. Once the particular position of each connector rod is determined, threaded nuts on the end of each bolt may be tightened to secure the rods in place.

Extending perpendicular from the plate in a direction away from the outwardly extending bolts is mandrel 172. The mandrel is sized to extend through the aforementioned annular housing 50 and become secured against axial rotation by clamping ring 52. To insure that the mandrel does not slip out of the housing, the mandrel has sufficient length to extend beyond the ring clamp and is provided with an opening through its exposed end portion for the insertion of a stop pin 174.

It will be noted that the workpiece mounting means has great versatility in that it may be rotated about the mandrel longitudinal axis within housing 50 and the connector rods may be individually moved about each of the bolts. In the preferred embodiment, there are four bolts extending perpendicular to plate 166 with each pin having a connector rod mounted thereon.

In operation, the present invention will provide a user with a series of attachments which may be used individually or together to form a hoist, jacking device or a workpiece mount. The lifting beam is convertible and removable to function with a jack unit as a hoist or jacking assembly. When used as a jacking assembly a unique cradle means is provided which may be canted, rotated or tilted to fit various types of transmissions, gear boxes or the like. Adjustable cross bars may be individually extended or retracted as desired and the overall cradle can be raised or lowered while maintaining a predetermined level relative to the horizontal. With the base frame being mounted on casters, the entire assembly may be moved about with or without a load and the leg casters can be locked to prevent inadvertent movement.

While preferred embodiments have been described above, it will be apparent that other modifications and improvements may be made to the essential elements of the invention without departing from the spirit and scope thereof. Accordingly, it is to be understood that the invention is not to be limited by the specific illustrative embodiments but only by the scope of the appended claims.

I claim:

1. A lifting and mounting apparatus comprising:

a base frame;

an elongated upright member having a bottom portion connected to said frame;

first support means located on the base frame proximate said bottom portion;

second support means located on the upright member above said bottom portion and upper pivot connection means located about the top portion of said upright member;

a lifting beam having an attachment end portion and a pivot end portion adapted for connection to said upright member wherein said attachment end portion includes a cradle means adapted to be releasably connected thereto;

said cradle means comprising a pivot rod extending beyond the end of the attachment end portion in a direction generally coextensive with the longitudinal axis of said lifting beam interconnecting said cradle with said attachment end portion;

a carriage member comprising an elongated beam extending transversely of said rod and mounted thereon for rotation about its normal axis, said rod freely extending through the carriage member to a terminal end having a first bracket immovably attached thereto;

second bracket means immovably attached to said carriage member in a manner coextensive with and offset from said first bracket means; and, adjustable linkage means interconnecting said brackets for regulating the angularity of said carriage member about said normal axis;

said lifting beam further including pivot connection means located intermediate of said end portions; and, a jack unit adapted to be secured to said first or second support means and said pivot connection means for raising and lowering said beam.

2. The apparatus of claim 1 wherein said pivot connection means comprises at least two connector assemblies spaced apart along the longitudinal extent of said beam whereby said jack unit may either be connected to a first one of said assemblies and said first support means for use of the apparatus as a jacking device or to a second one of said assemblies and said second support means for use of the apparatus as an overhead hoist.

3. The apparatus of claim 1 including a tie-rod pivotally connecting the upright member with the cradle means to maintain the normal axis of said cradle means in a level disposition during movement of the lifting beam.

4. The apparatus of claim 3 wherein the tie-rod is positioned coextensive with said lifting beam and is connected to the lower portion of the upright member at one end and connected to the carriage member at the opposite end.

5. The apparatus of claim 1 wherein said carriage member includes transversely extending cross bars adapted to support a workpiece.

6. The apparatus of claim 5 wherein said carriage member is provided with transverse slots through which said cross bars slideably extend.

7. The apparatus of claim 1 including a workpiece mounting means adapted to be connected to the upright member by an attachment means, said workpiece mounting means comprising a plate having a plurality of outwardly projecting stationary pins which extend through slotted connector rods, each of said rods being movable upon a respective pin in a manner to facilitate connection to a workpiece.

8. The apparatus of claim 7 wherein the attachment means comprises a housing and locking means and the plate includes a mandrel projecting therefrom which is adapted to be inserted through said housing and secured against movement by said locking means.

* * * * *